US010819013B2

(12) United States Patent
Lin

(10) Patent No.: US 10,819,013 B2
(45) Date of Patent: Oct. 27, 2020

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 30 days.

(21) Appl. No.: 16/385,615

(22) Filed: Apr. 16, 2019

(65) Prior Publication Data

US 2019/0348750 A1 Nov. 14, 2019

(30) Foreign Application Priority Data

May 8, 2018 (CN) ..... 2018 1 0431335

(51) Int. Cl.

| | |
|---|---|
| ***H01Q 1/24*** | (2006.01) |
| ***H01Q 1/48*** | (2006.01) |
| ***H01Q 5/30*** | (2015.01) |
| ***H01Q 1/52*** | (2006.01) |

(52) U.S. Cl.

CPC ..... *H01Q 1/243* (2013.01); *H01Q 1/48* (2013.01); *H01Q 1/521* (2013.01); *H01Q 5/30* (2015.01)

(58) Field of Classification Search

None

See application file for complete search history.

(56) References Cited

U.S. PATENT DOCUMENTS

| | | | | |
|---|---|---|---|---|
| 10,305,168 | B2 | 5/2019 | Liu et al. | |
| 2013/0076579 | A1 | 3/2013 | Zhang et al. | |
| 2013/0162496 | A1 | 6/2013 | Wakabayashi | |
| 2017/0117614 | A1 | 4/2017 | Wu et al. | |
| 2018/0191077 | A1* | 7/2018 | Lee | H01Q 1/243 |
| 2019/0067821 | A1* | 2/2019 | Kim | H01Q 9/0421 |
| 2020/0058983 | A1* | 2/2020 | Chen | H01Q 21/28 |

FOREIGN PATENT DOCUMENTS

| | | | |
|---|---|---|---|
| CN | 103682639 | A | 3/2014 |
| CN | 203536554 | U | 4/2014 |
| CN | 105305066 | A | 2/2016 |
| CN | 105932408 | A | 9/2016 |
| CN | 107026324 | A | 8/2017 |

* cited by examiner

*Primary Examiner* — Jany Richardson
(74) *Attorney, Agent, or Firm* — ScienBiziP, P.C.

(57) ABSTRACT

An antenna structure includes a housing, a first feed source, and a second feed source. The housing includes a side frame. The side frame defines a first gap, a second gap, and a groove. The first gap, the second gap, and the groove divide the side frame into a first radiating portion, an isolation portion, and a second radiating portion. The first feed source is electrically connected to the first radiating portion for supplying current to the first radiating portion. The second feed source is electrically connected to or being coupled to the second radiating portion for supplying current to the second radiating portion. The isolation portion is positioned between the first radiating portion and the second radiating portion. The isolation portion is grounded. The current from the first radiating portion and the current from the second radiating portion are respectively coupled to the isolation portion.

23 Claims, 18 Drawing Sheets

100c

100d

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Antennas are important components in wireless communication devices for receiving and transmitting wireless signals at different frequencies, such as signals in Long Term Evolution Advanced (LTE-A) frequency bands. However, the antenna structure is complicated and occupies a large space in the wireless communication device, which is inconvenient for miniaturization of the wireless communication device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
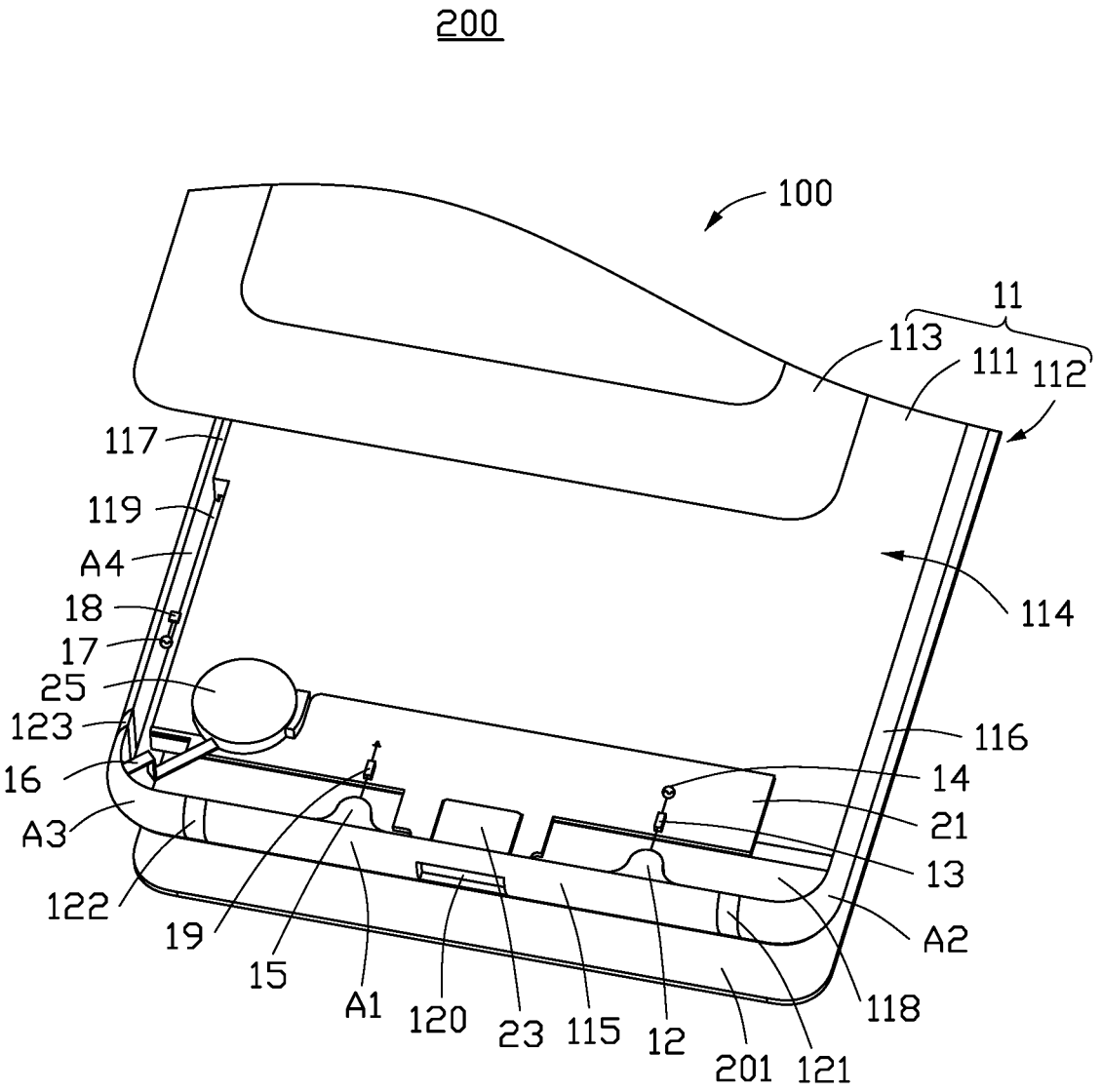
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the same.

Figure 2:
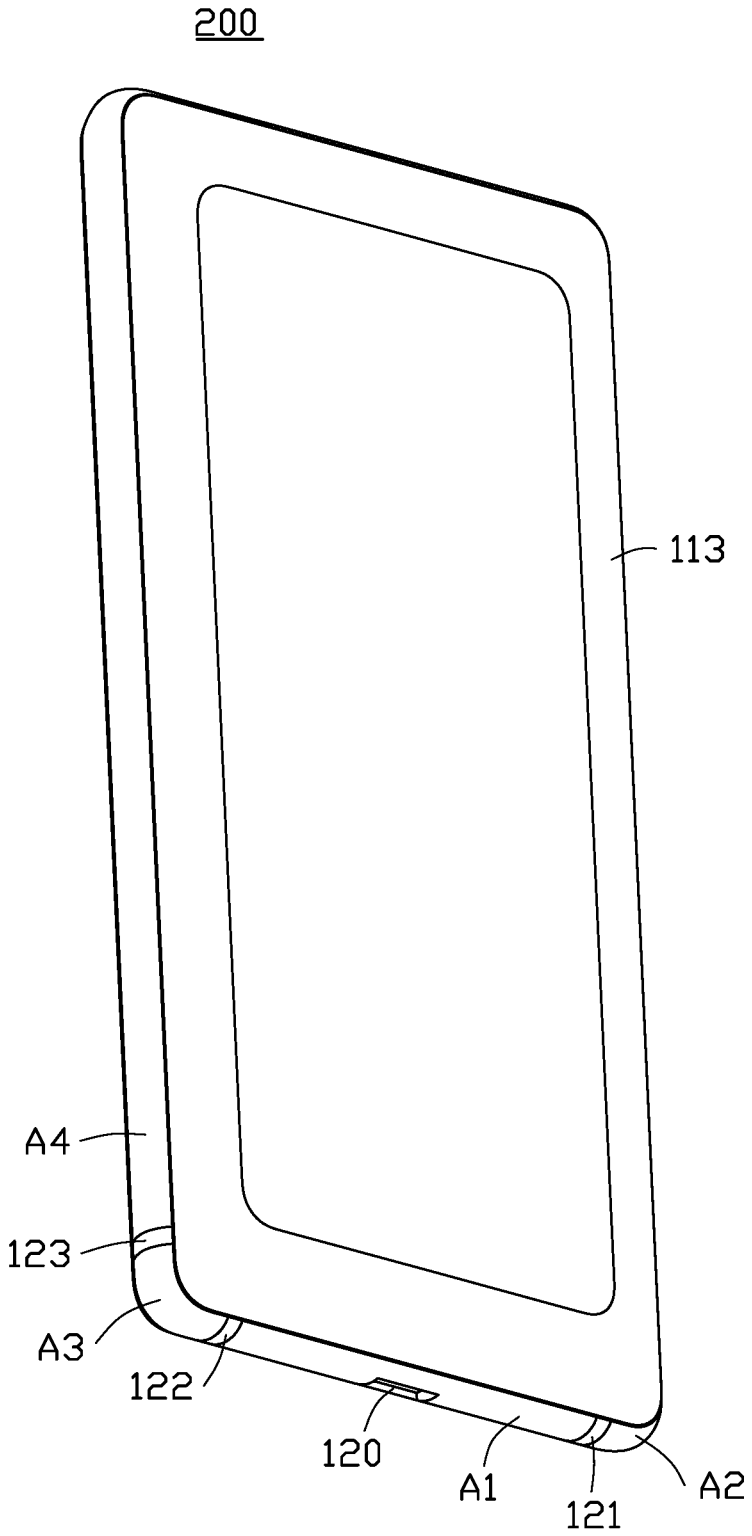
FIG. 2 is an assembled, isometric view of the wireless communication device of FIG. 1.

FIG. 1 and FIG. 2 illustrate an embodiment of a wireless communication device 200 using an antenna structure 100. The wireless communication device 200 can be, for example, a mobile phone or a personal digital assistant. The antenna structure 100 can receive and transmit wireless signals.

Figure 3:
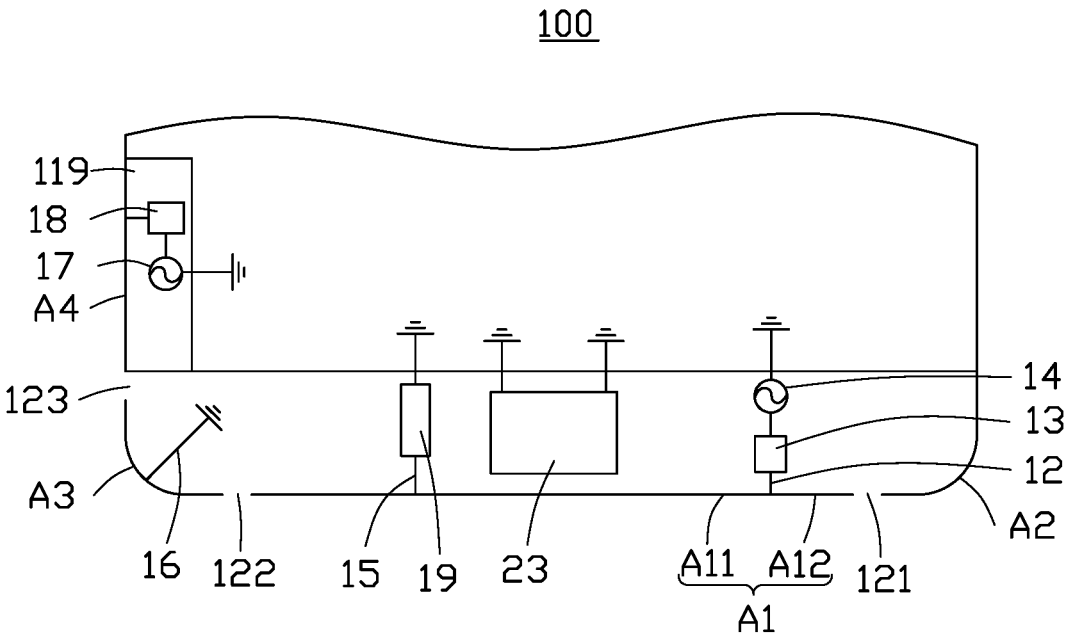
FIG. 3 is a circuit diagram of the antenna structure of FIG. 1.

FIG. 3 shows the antenna structure 100 includes a housing 11, a first connecting portion 12, a first matching circuit 13, a first feed source 14, a second connecting portion 15, a ground portion 16, a second feed source 17, and a second matching circuit 18.

The housing 11 contains the wireless communication device 200. The housing 11 includes at least a middle frame 111, a side frame 112, and a backboard 113. The middle frame 111 is substantially a rectangular sheet. The middle frame 111 is made of metallic material. The side frame 112 is substantially annular. The side frame 112 is made of metallic material. In this embodiment, the side frame 112 is positioned around a periphery of the middle frame 111. The side frame 112 can be integral with the middle frame 111. One side of the side frame 112 away from the middle frame 111 defines an opening (not labeled). The wireless communication device 200 includes a display 201. The display 201 is received in the opening. The display 201 has a display surface. The display surface is exposed at the opening.

In an embodiment, the backboard 113 is made of insulating material, for example, plastic or glass. The backboard 113 is positioned around a periphery of the side frame 112. The backboard 113 is positioned parallel to the display surface of the display 201 and the middle frame 111. In one embodiment, the backboard 113, the side frame 112, and the middle frame 111 cooperatively form a receiving space 114. The receiving space 114 can receive a substrate, a processing unit, or other electronic components or modules.

In an embodiment, the side frame 112 includes an end portion 115, a first side portion 116, and a second side portion 117. The end portion 115 is a bottom portion of the wireless communication device 200. The first side portion 116 is spaced apart from and parallel to the second side portion 117. The end portion 115 has first and second ends. The first side portion 116 is connected to the first end of the end portion 115 and the second side portion 117 is connected to the second end of the end portion 115.

In one embodiment, a side of the middle frame 111 adjacent to the end portion 115 defines a notch, thereby forming a corresponding clearance area 118. In this embodiment, a size of the clearance area 118 is substantially 68.8*7.3 $mm^2$. One side of the middle frame 111 adjacent to the second side portion 117 further defines a slit 119. The slit 119 is substantially straight and communicates with the clearance area 118. The slit 119 has a width of about 1.5 mm and a length of about 20 mm.

In this embodiment, the wireless communication device 200 further includes a substrate 21 and at least one electronic element. In an embodiment, the substrate 21 is made of dielectric material, for example, epoxy resin glass fiber (FR4) or the like. The substrate 21 is positioned in the receiving space 114 above the clearance area 118. In this embodiment, the wireless communication device 200 includes at least two electronic elements, for example, a first electronic element 23 and a second electronic element 25.

The first electronic element 23 is a Universal Serial Bus (USB) module. The first electronic element 23 is positioned on the substrate 21. The second electronic element 25 is a vibrator. The second electronic element 25 is positioned on the substrate 21 and is spaced apart from the first electronic element 23.

The side frame 112 further defines a through hole 120, a first gap 121, a second gap 122, and a groove 123. The through hole 120 is defined at a middle position of the end portion 115 and passes through the end portion 115. The through hole 120 corresponds to the first electronic element 23. Then, the first electronic element 23 is partially exposed from the through hole 120. A USB device can be inserted in the through hole 120 and be electrically connected to the first electronic element 23.

In an embodiment, the first gap 121 is defined at the side frame 112 between the through hole 120 and the first side portion 116. The first gap 121 passes through and extends to cut across the side frame 112. The second gap 122 is defined at the side frame 112 between the through hole 120 and the second side portion 117. The second gap 122 passes through and extends to cut across the side frame 112. The groove 123 is defined at a position of the second side portion 117 adjacent to the second gap 122. The groove 123 passes through and extends to cut across the side frame 112.

In an embodiment, the housing 11 is divided into four portions by the first gap 121, the second gap 122, and the groove 123. The four portions are a first radiating portion A1, a coupling portion A2, an isolation portion A3, and a second radiating portion A4. A portion of the side frame 112 between the first gap 121 and the second gap 122 forms the first radiating portion A1. A portion of the side frame 112 extends from a side of the first gap 121 to the first side portion 116 forms the coupling portion A2. A portion of the side frame 112 between the second gap 122 and the groove 123 forms the isolation portion A3. A portion of the side frame 112 extends from a side of the groove 123 to the second side portion 117 forms the second radiating portion A4. In this embodiment, the isolation portion A3 is positioned between the first radiating portion A1 and the second radiating portion A4 by the second gap 122 and the groove 123. The isolation portion A3, the first radiating portion A1, and the second radiating portion A4 are spaced apart from each other.

A width of the first gap 121, a width of the second gap 122, and a width of the groove 123 are all about 2 mm. In this embodiment, the first gap 121, the second gap 122, and the groove 123 are all filled with insulating material, for example, plastic, rubber, glass, wood, ceramic, or the like.

In an embodiment, the first connecting portion 12 can be a screw, a feeding line, a probe, or other connecting structures. The first connecting portion 12 is positioned in the receiving space 114. One end of the first connecting portion 12 is electrically connected to one side of the first radiating portion A1 adjacent to the first gap 121. Another end of the first connecting portion 12 is electrically connected to the first feed source 14 through the first matching circuit 13 for feeding current to the first radiating portion A1. Another end of the first feed source 14 is grounded.

Figure 4:
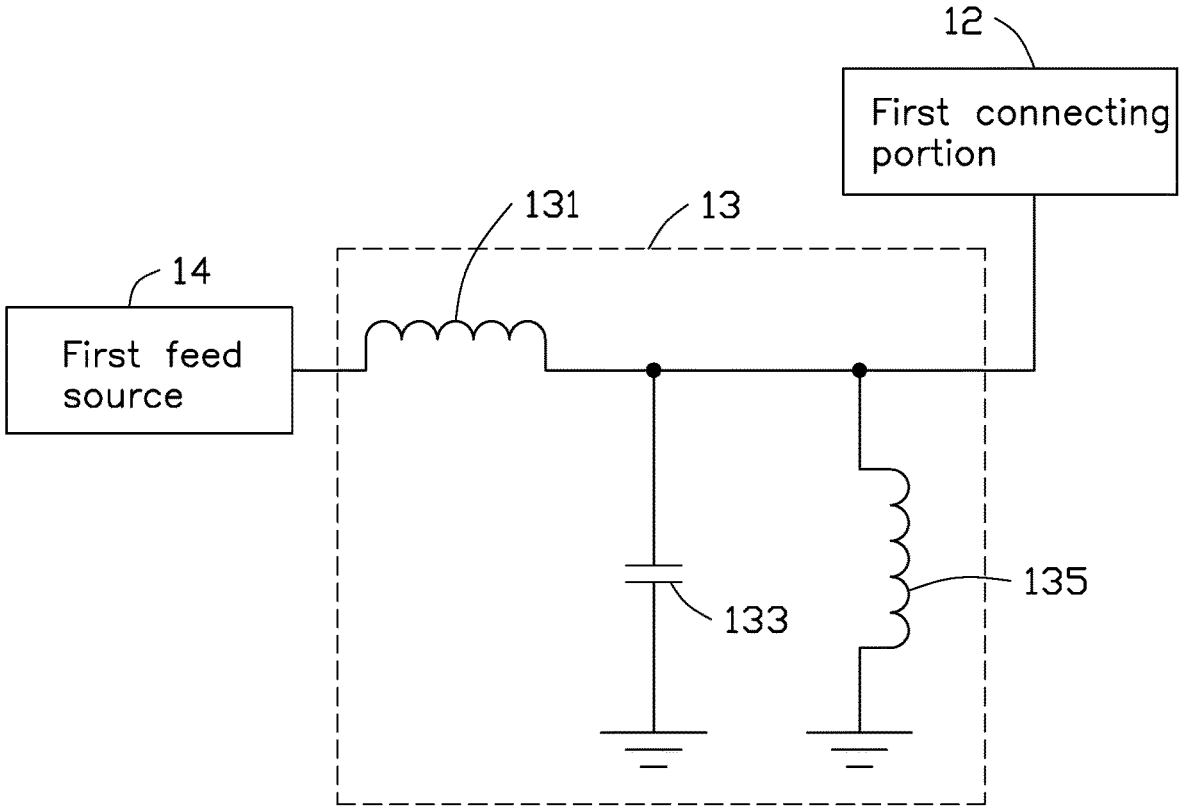
FIG. 4 is a circuit diagram of a first matching circuit of the antenna structure of FIG. 3.

As illustrated in FIG. 4, in this embodiment, the first matching circuit 13 includes a first matching element 131, a second matching element 133, and a third matching element 135. One end of the first matching element 131 is electrically connected to the first feed source 14. Another end of the first matching element 131 is electrically connected to one end of the second matching element 133, one end of the third matching element 135, and the first connecting portion 12. Another end of the second matching element 133 and another end of the third matching element 135 are both grounded.

In one embodiment, the first matching element 131 is an inductor having an inductance value of about 2.7 nH. The second matching element 133 is a capacitor having a capacitance value of about 1.8 pF. The third matching element 135 is an inductor having an inductance value of about 6.8 nH.

In FIG. 3, the first connecting portion 12 further divides the first radiating portion A1 into two portions. The two portions are a first radiating section A11 and a second radiating section A12. A portion of the side frame 112 between the first connecting portion 12 and the second gap 122 forms the first radiating section A11. A portion of the side frame 112 between the first connecting portion 12 and the first gap 121 forms the second radiating section A12. In an embodiment, a location of the first connecting portion 12 does not correspond to a middle position of the first radiating portion A1, the first radiating section A11 is longer than the second radiating section A12.

The second connecting portion 15 can be a screw, a feed line, a probe, or other connecting structures. The second connecting portion 15 is positioned in the receiving space 114. One end of the second connecting portion 15 is electrically connected to one end of the first radiating section A11. Another end of the second connecting portion 15 is grounded.

The ground portion 16 is positioned in the receiving space 114. One end of the ground portion 16 is electrically connected to the isolation portion A3. Another end of the ground portion 16 is grounded for grounding the isolation portion A3.

In this embodiment, the second feed source 17 is positioned in the slit 19. One end of the second feed source 17 is electrically connected to the second radiating portion A4 through the second matching circuit 18. Another end of the second feed source 17 is grounded.

Figure 5:
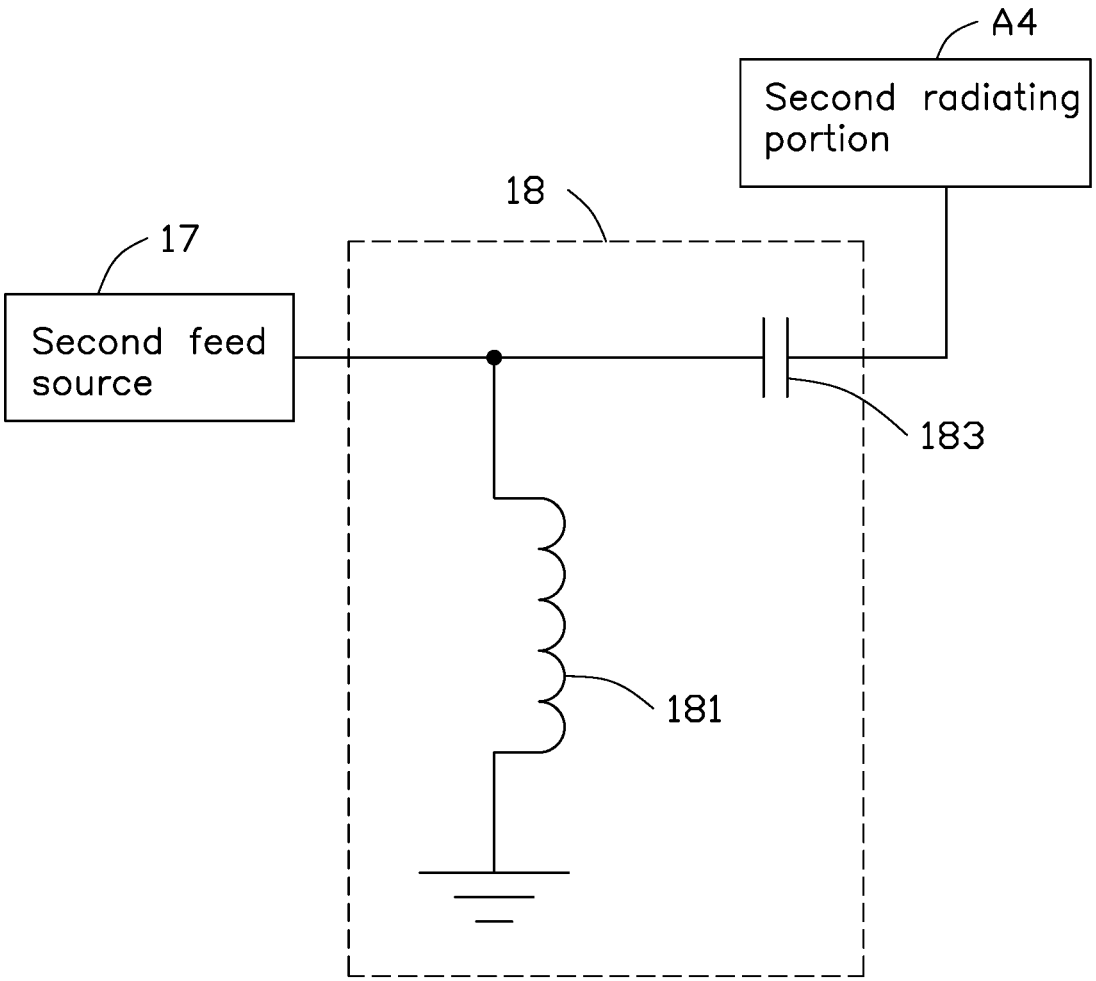
FIG. 5 is a circuit diagram of a second matching circuit of the antenna structure of FIG. 3.

As illustrated in FIG. 5, in this embodiment, the second matching circuit 18 includes a first matching unit 181 and a second matching unit 183. One end of the first matching unit 181 is electrically connected to the second feed source 17 and one end of the second matching unit 183. Another end of the first matching unit 181 is grounded. Another end of the second matching unit 183 is electrically connected to the second radiating portion A4.

In one embodiment, the first matching unit 181 is an inductor having an inductance value of about 5.1 nH. The second matching unit 183 is a capacitor having a capacitance value of about 1.5 pF.

Figure 6:
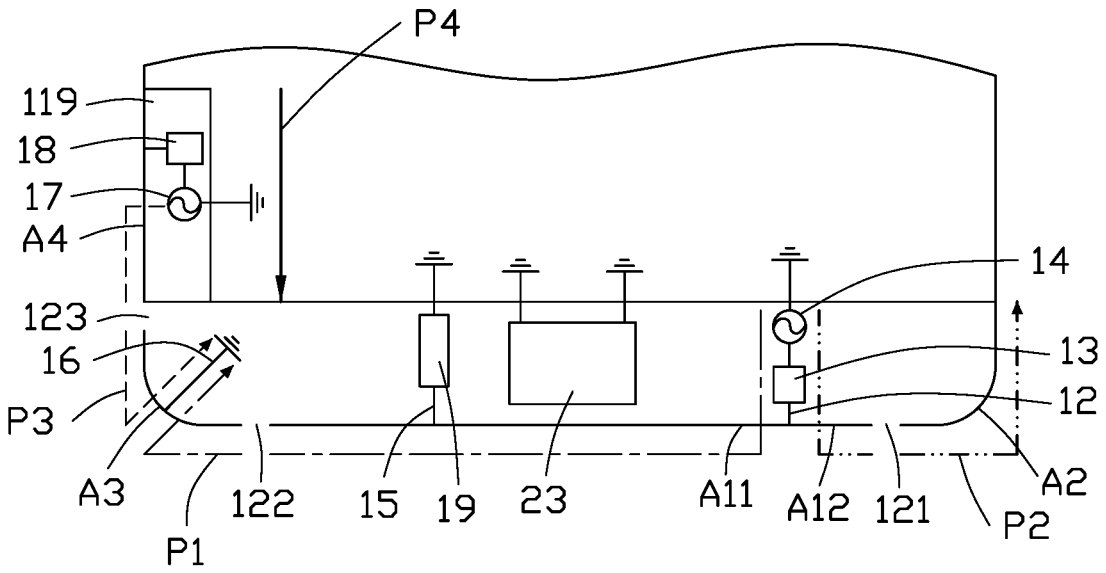
FIG. 6 is a current path distribution graph of the antenna structure of FIG. 3.

FIG. 6 shows, in an embodiment, when the first feed source 14 supplies current, the current flows through the first matching circuit 13, the first connecting portion 12, and the first radiating section A11. The current is then coupled to the isolation portion A3 through the second gap 122, and is grounded through the ground portion 16 (Per path P1). Then the first radiating section A11 activates a first operating mode to generate radiation signals in a first radiation frequency band.

When the first feed source 14 supplies current, the current flows through the first matching circuit 13, the first connecting portion 12, and the second radiating section A12. The current is then coupled to the coupling portion A2 through the first gap 121 (Per path P2). Then the first feed source 14, the second radiating section A12, and the coupling portion A2 cooperatively form a coupling-feed antenna through the first gap 121 to activate a second operating mode to generate radiation signals in a second radiation frequency band.

When the second feed source 17 supplies current, the current flows through the second matching circuit 18 and the second radiating portion A4. The current is then coupled to the isolation portion A3 through the groove 123, and is grounded through the ground portion 16 (Per path P3). Then the second feed source 17, the second radiating portion A4, and the isolation portion A3 cooperatively form a coupling-feed antenna through the groove 123 to activate a third operating mode to generate radiation signals in a third radiation frequency band. Additionally, the second radiating portion A4 further forms a slit antenna through the slit 119 to activate a fourth operating mode to generate radiation signals in a fourth radiation frequency band.

In an embodiment, the first operating mode includes LTE-A low and high frequency operating modes. The second operating mode is a LTE-A middle frequency operating mode. The first radiation frequency band and the second radiation frequency are about LTE-A 704-960 MHz and 1530-2690 MHz. The third operating mode is a LTE-A middle frequency operating mode. The fourth operating mode is a LTE-A high frequency operating mode. The third radiation frequency band and the fourth radiation frequency are about LTE-A 1805-3640 MHz.

Figure 7:
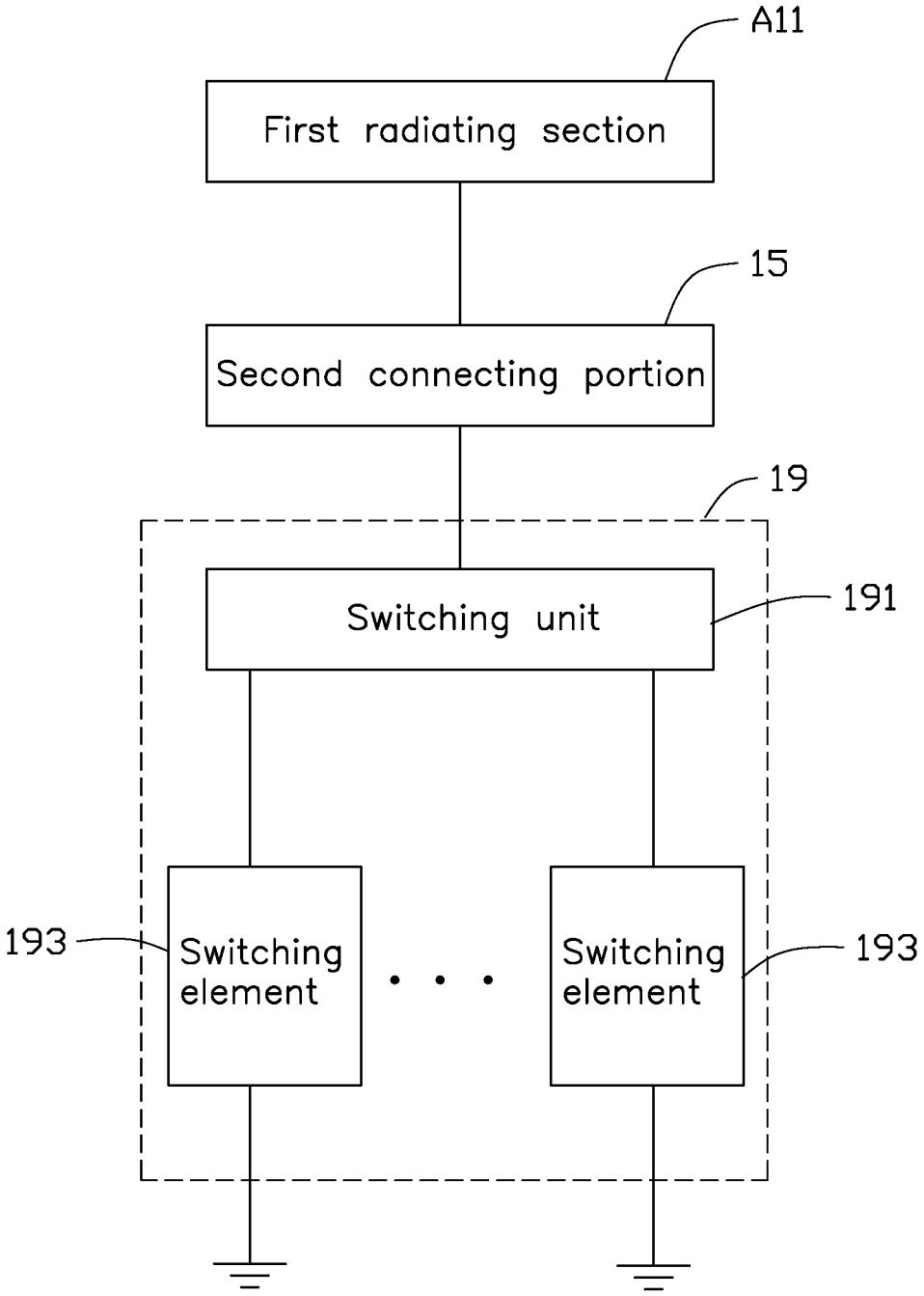
FIG. 7 is a circuit diagram of a switching circuit of the antenna structure of FIG. 3.

FIG. 7 shows, in an embodiment, the antenna structure 100 further includes a switching circuit 19. One end of the switching circuit 19 is electrically connected to the second connecting portion 15. Then, the switching circuit 19 is electrically connected to the first radiating section A11 through the second connecting portion 15. Another end of the switching circuit 19 is grounded.

In an embodiment, the switching circuit 19 includes a switching unit 191 and a plurality of switching elements 193. The switching unit 191 is electrically connected to the second connecting portion 15. Then, the switching unit 191 is electrically connected to the first radiating section A11 through the second connecting portion 15. The switching elements 193 can be an inductor, a capacitor, or a combination of the inductor and the capacitor. The switching elements 193 are connected in parallel to each other. One end of each switching element 193 is electrically connected to the switching unit 191. The other end of each switching element 193 is grounded.

Through control of the switching unit 191, the first radiating section A11 can be switched to connect with different switching elements 193. Since each switching element 193 has a different impedance, frequencies of the low frequency band of the first operating mode can be effectively adjusted.

For example, in an embodiment, the switching circuit 19 includes four different switching elements 193. Through control of the switching unit 191, the first radiating section A11 can be switched to connect with the four different switching elements 193. For example, the first radiating section A11 can be switched to connect with an inductor having an inductance value of about 39 nH, an inductor having an inductance value of about 56 nH, an inductor having an inductance value of about 82 nH, or be switched to a floating state (that is, the first radiating section A11 does not connect with any element). Then, a low frequency band of the first operating mode can cover a frequency band of LTE-A 704-960 MHz.

In this embodiment, the first radiating portion A1 and the coupling portion A2 form a first antenna. The first antenna is a main antenna. Through setting the first feed source 14, the second connecting portion 15, and together with corresponding first matching circuit 13 and the switching circuit 19, the first antenna can be operated in the first radiation frequency band and the second radiation frequency band, which meets the needs of 2G/3G/4G of the main antenna.

The second radiating portion A4 forms a second antenna. In this embodiment, the second antenna is a diversity antenna. Through setting the second feed source 17, the corresponding second matching circuit 18, and making an end of the slit 19 being coupled with the isolation portion A3, a bandwidth of the second antenna can be effectively added and the second antenna can be operated in the third radiation frequency band and the fourth radiation frequency band, which meets the bandwidth needs of middle and high frequency antennas.

The paths P1 and P3 of FIG. 6 both pass through the isolation portion A3, but belong to different radiation frequency bands, which can effectively improve an isolation between the first antenna and the second antenna.

In this embodiment, the isolation portion A3 is positioned between the first antenna and the second antenna. The isolation portion A3 is further grounded through the ground portion 16. Then the isolation portion A3 can effectively improve an isolation between the first antenna and the second antenna, and also be served as a ground coupling-extended section of the first antenna and the second antenna to improve a bandwidth and an efficiency of the first antenna and the second antenna. Similarly, in the first antenna, the coupling portion A2 is mainly configured to improve a bandwidth and an efficiency of the first antenna.

Figure 8:
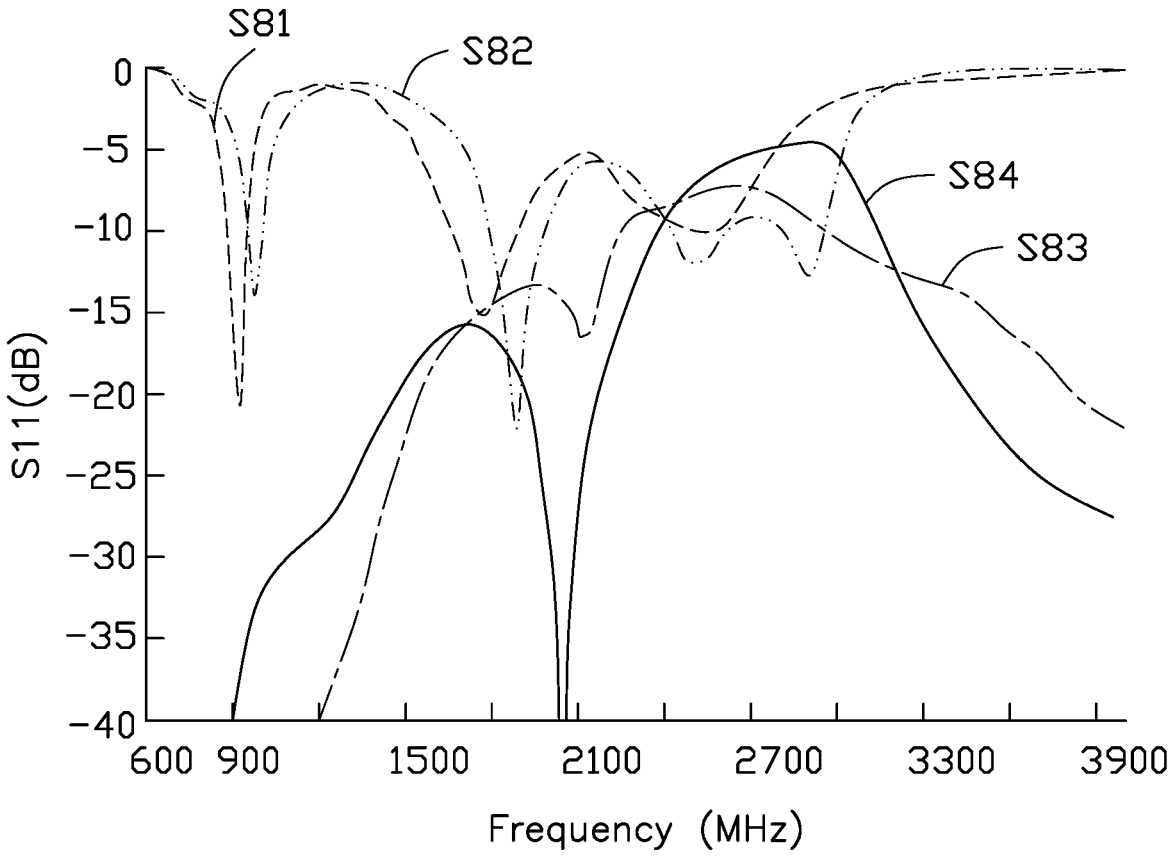
FIG. 8 is a scattering parameter graph of a first antenna when the antenna structure of FIG. 1 has an isolation portion and does not have the isolation portion.

Refers to FIG. 8, FIG. 8 mainly discusses an influence of the isolation portion A3 on the first antenna. Curve S81 is a scattering parameter of the first antenna when the antenna structure 100 includes the isolation portion A3. Curve S82 is a scattering parameter of the first antenna when the antenna structure 100 does not include the isolation portion A3. Curve S83 is an isolation between the first antenna and the second antenna when the antenna structure 100 includes the isolation portion A3. Curve S84 is an isolation between the first antenna and the second antenna when the antenna structure 100 does not include the isolation portion A3.

In views of curve S81 to curve S84, when the antenna structure 100 does not include the isolation portion A3, the mode of the first antenna is increased, and an isolation between the first antenna and the second antenna is degraded by −4.5 dB. When the antenna structure 100 adds the isolation portion A3, the isolation between the first antenna and the second antenna can be improved to −7.3 dB.

Figure 9:
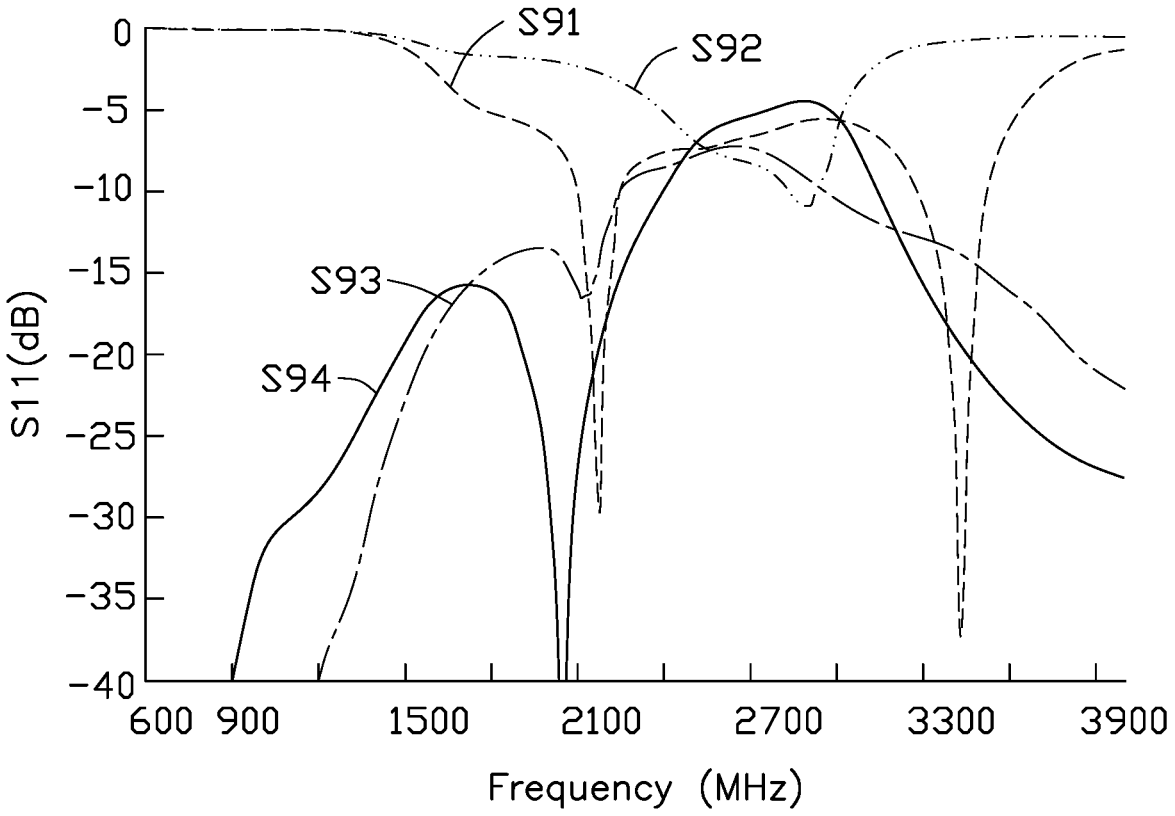
FIG. 9 is a scattering parameter graph of a second antenna when the antenna structure of FIG. 1 has an isolation portion and does not have the isolation portion.

Refers to FIG. 9, FIG. 9 mainly discusses an influence of the isolation portion A3 on the second antenna. Curve S91 is a scattering parameter of the second antenna when the antenna structure 100 includes the isolation portion A3. Curve S92 is a scattering parameter of the second antenna when the antenna structure 100 does not include the isolation portion A3. Curve S93 is an isolation between the first antenna and the second antenna when the antenna structure 100 includes the isolation portion A3. Curve S94 is an isolation between the first antenna and the second antenna when the antenna structure 100 does not include the isolation portion A3.

In views of curve S91 to curve S94, when the antenna structure 100 adds the isolation portion A3, a bandwidth of the second antenna can be up to 1870 MHz (1770-3640 MHz). When the antenna structure 100 does not include the isolation portion A3, the bandwidth of the second antenna is only 600 MHz (2400-3000 MHz). Then the isolation portion A3 can effectively improve the isolation between the first antenna and the second antenna, an antenna bandwidth, or other characteristics.

Figure 10:
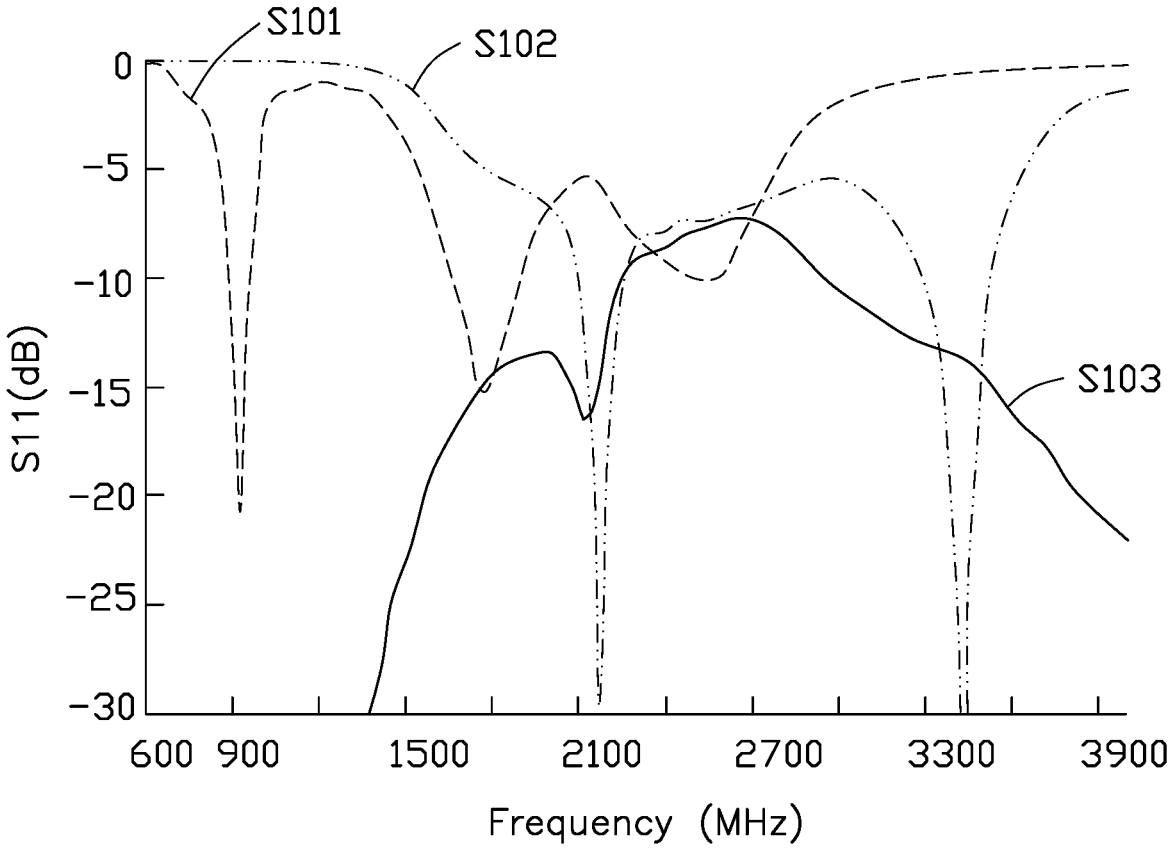
FIG. 10 is a scattering parameter graph of the antenna structure of FIG. 1.

FIG. 10 is a scattering parameter graph of the antenna structure 100. Curve S101 is a scattering parameter of the first antenna of the antenna structure 100. Curve S102 is a scattering parameter of the second antenna of the antenna structure 100. Curve S103 is an isolation between the first antenna and the second antenna.

In views of curves S101 to S103, the low frequency band of the first antenna matched with the switching circuit 19 can meet the bandwidth requirement of the 2G/3G/4G communication product (704-960 MHz and 1530-2770 MHz). The bandwidth of the second antenna can meet requirements of the middle frequency band and the high frequency band (1770-3640 MHz). An isolation between the first antenna and the second antenna is less than −7 dB. The antenna structure 100 can be applied to a multi-antenna design of 4*4 multi-input multi-output (MIMO).

Figure 11:
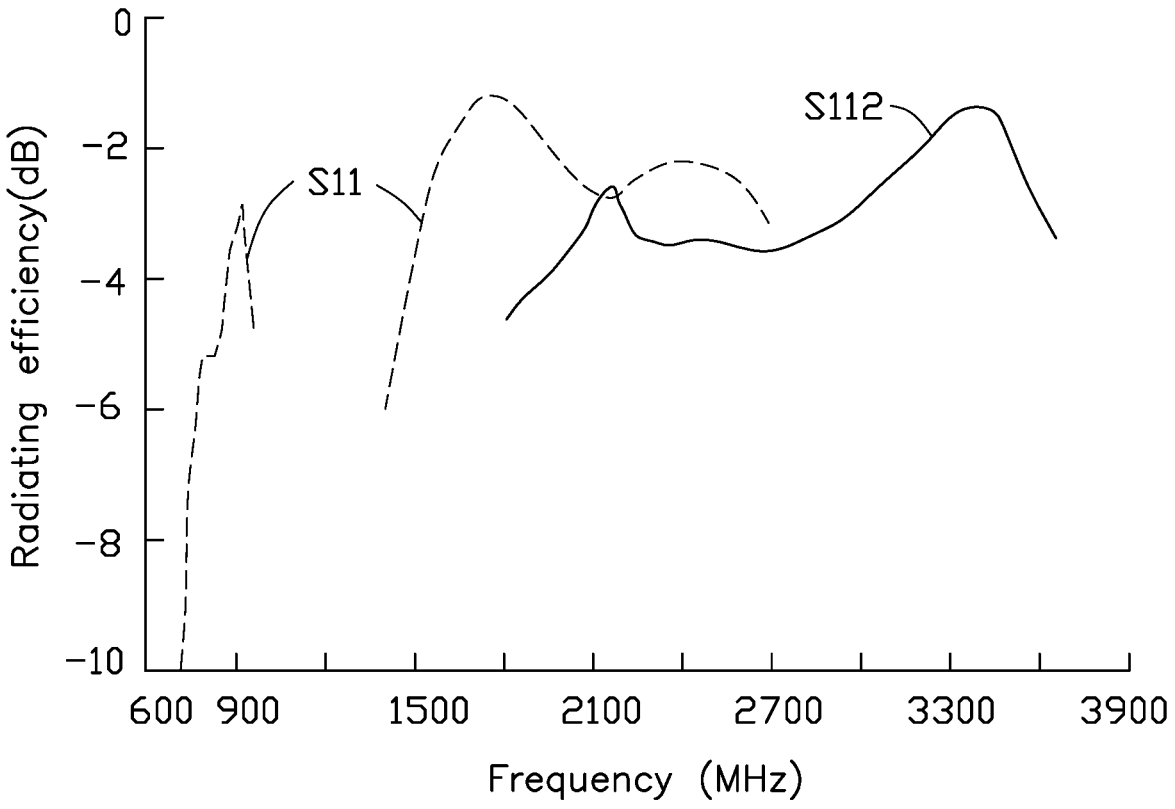
FIG. 11 is a radiating efficiency graph of the antenna structure of FIG. 1.

FIG. 11 is a radiating efficiency graph of the antenna structure 100. Curve S111 is a total radiating efficiency of the first antenna of the antenna structure 100. Curve S112 is a total radiating efficiency of the second antenna of the antenna structure 100. Obviously, the antenna structure 100 has good radiation efficiency characteristics in the effective frequency bands. The efficiency of the low frequency band (704-960 MHz) of the first antenna is greater than −5 dB. The efficiency of the middle and high frequency bands (1530-2690 MHz) of the first antenna is greater than −3 dB. The efficiency of the middle and high frequency bands (1805-3640 MHz) of the second antenna is greater than −4.5 dB.

Figure 12:
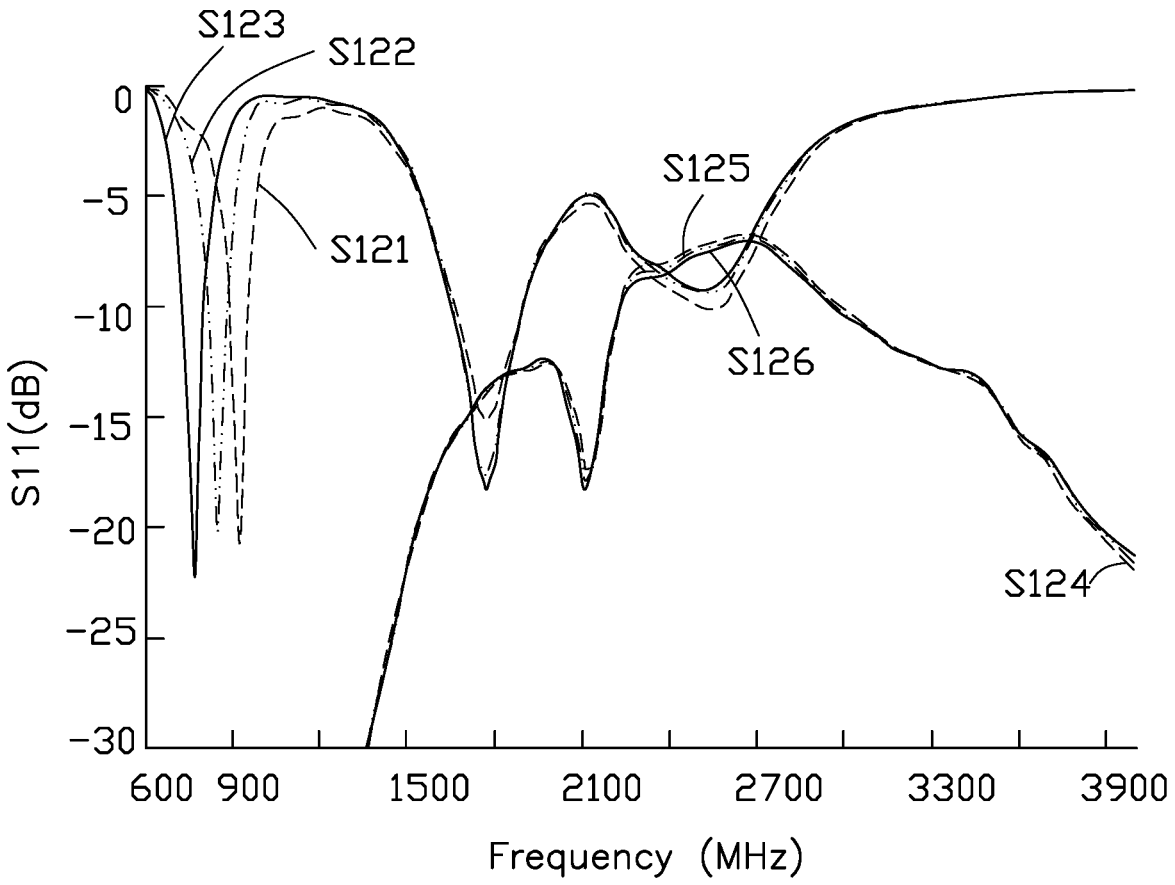
FIG. 12 is a scattering parameter graph of the antenna structure when the switching circuit of FIG. 3 is switched to different switching elements.

FIG. 12 is a scattering parameter graph of the antenna structure 100 when the switching circuit 19 is switched to connect with different switching elements 193. Curve S121 is a scattering parameter of the antenna structure 100 when the switching circuit 19 is switched to connect with one switching element 193 having an inductance value of about 39 nH. Curve S122 is a scattering parameter of the antenna structure 100 when the switching circuit 19 is switched to connect with one switching element 193 having an inductance value of about 82 nH. Curve S123 is a scattering parameter of the antenna structure 100 when the switching circuit 19 is switched to a floating state. Curve S124 is an isolation between the first antenna and the second antenna when the switching circuit 19 is switched to connect with one switching element 193 having an inductance value of about 39 nH. Curve S125 is an isolation between the first antenna and the second antenna when the switching circuit 19 is switched to connect with one switching element 193 having an inductance value of about 82 nH. Curve S126 is an isolation between the first antenna and the second antenna when the switching circuit 19 is switched to the floating state.

Obviously, when the switching circuit 19 switches, the switching of the switching circuit 19 does not affect the isolation between the first antenna and the second antenna. The switching circuit 19 is only used to change the low frequency operating mode of the first antenna and does not affect the middle and high frequency operating modes. This feature is beneficial to carrier aggregation (CA) of LTE-A.

Figure 13:
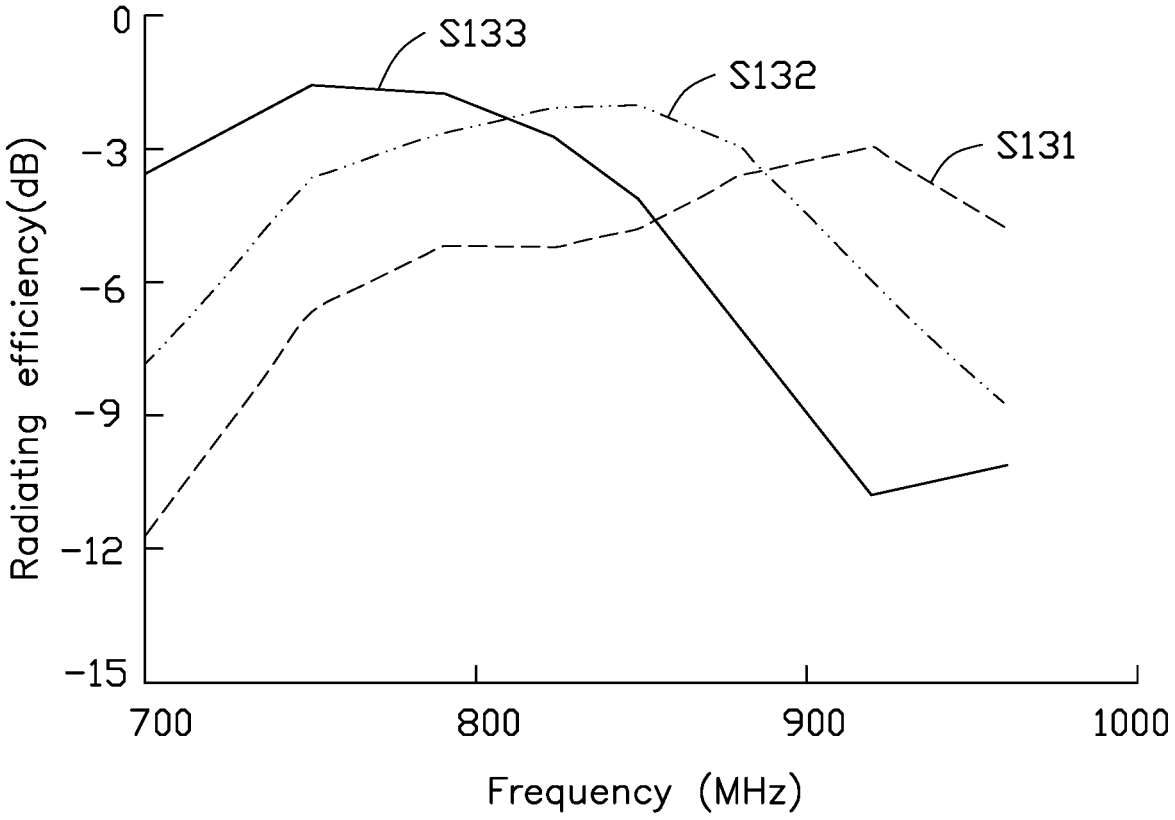
FIG. 13 is a radiating efficiency graph of the first antenna when the switching circuit of FIG. 3 is switched to different switching elements.

FIG. 13 is a radiating efficiency graph of the first antenna of the antenna structure 100 when the switching circuit 19 is switched to connect with different switching elements 193. Curve S131 is a total radiating efficiency of the first antenna when the switching circuit 19 is switched to connect with one switching element 193 having an inductance value of about 39 nH. Curve S132 is a total radiating efficiency of the first antenna when the switching circuit 19 is switched to connect with one switching element 193 having an inductance value of about 82 nH. Curve S133 is a total radiating efficiency of the first antenna when the switching circuit 19 is switched to a floating state.

Figure 14:
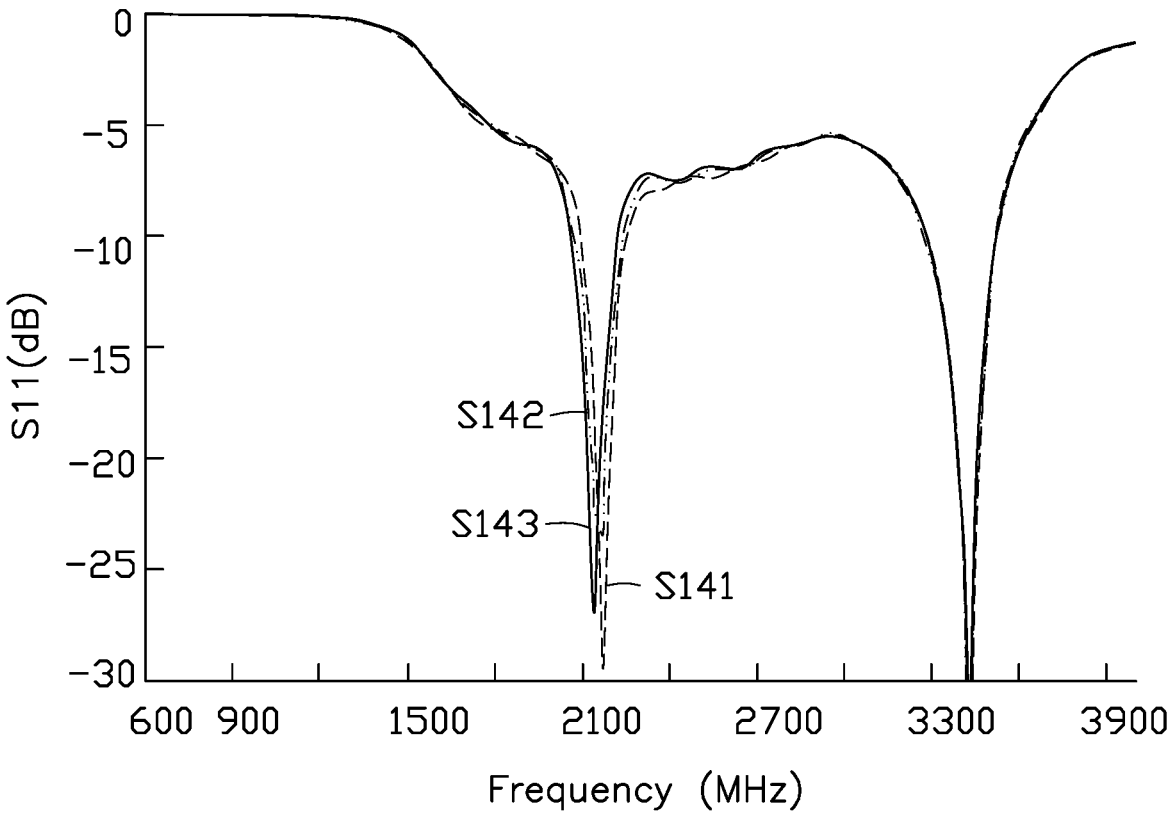
FIG. 14 is a radiating efficiency graph of the second antenna when the switching circuit of FIG. 3 is switched to different switching elements.

FIG. 14 is a radiating efficiency graph of the second antenna of the antenna structure 100 when the switching circuit 19 is switched to connect with different switching elements 193. Curve S141 is a scattering parameter of the second antenna when the switching circuit 19 is switched to connect with one switching element 193 having an inductance value of about 39 nH. Curve S142 is a scattering parameter of the second antenna when the switching circuit 19 is switched to connect with one switching element 193 having an inductance value of about 82 nH. Curve S143 is a scattering parameter of the second antenna when the switching circuit 19 is switched to a floating state.

Obviously, in FIGS. 13 and 14, by setting the switching circuit 19, the low frequency band (704-960 MHz) of the first antenna has a good antenna efficiency, and the radiation efficiency is greater than −5 dB. At the same time, the switching circuit 19 does not affect the characteristics of the second antenna.

As illustrated in FIG. 6, the low frequency and the high frequency of the first antenna are mainly excited by the first radiating portion A1 and the isolation portion A3. The middle frequency of the first antenna is mainly excited by the first radiating portion A1 and the coupling portion A2. The high frequency of the second antenna is mainly excited by the slit 119. The middle frequency of the second antenna is mainly excited through the end of the slit 119 being coupled to the isolation portion A3. Obviously, the antenna structure 100 can avoid the same frequency band in the first antenna and the second antenna, and can effectively improve the isolation between the first antenna and the second antenna.

Referring to FIG. 15*a* to FIG. 15*g*, in other embodiments, the first antenna, the second antenna, and the isolation portion A3 are not limited to the above configuration, and other configurations may be adopted. It is only be ensured that the isolation portion A3 is spaced between the first antenna and the second antenna, and is grounded. Then the isolation portion A3 can effectively isolate the first antenna and the second antenna to improve the isolation between the first antenna and the second antenna. The isolation portion A3 can further increase the characteristics of the bandwidth and efficiency of the antenna structure 100.

Figure 15A:
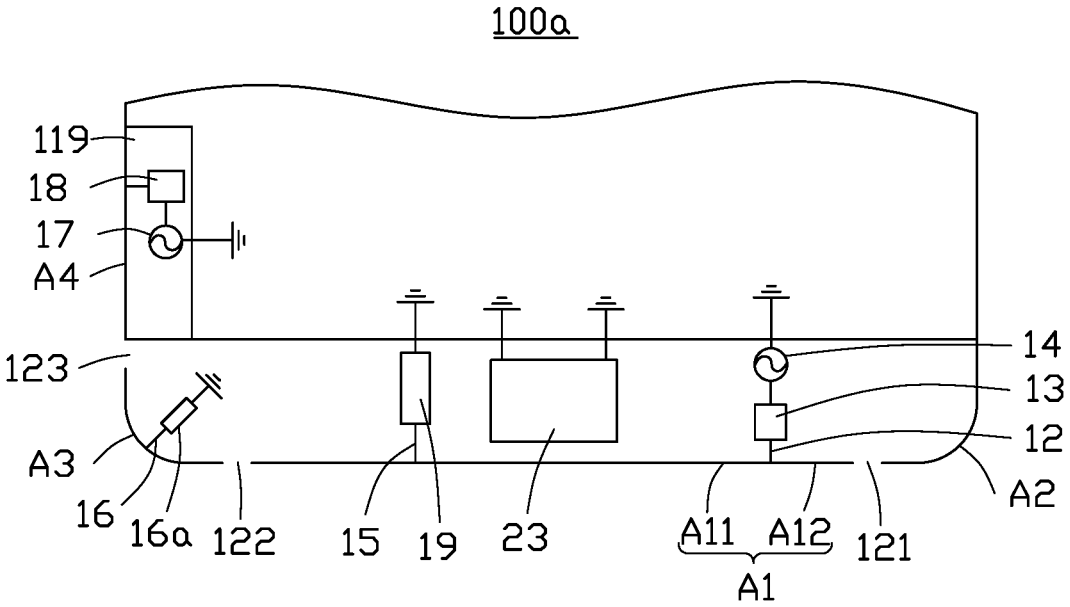
FIG. 15*a* to FIG. 15*g* are isometric views of other embodiments of a wireless communication device using an antenna structure.

For example, as illustrated in FIG. 15*a*, in one embodiment, the antenna structure 100*a* includes the first antenna, the second antenna, the isolation portion A3, the ground portion 16, and a resistance unit 16*a*. The resistance unit 16*a* can be a resistor, an inductor, a capacitor, a switching circuit, or other resistance element. One end of the resistance unit 16*a* is electrically connected to the ground portion 16. Another end of the resistance unit 16*a* is grounded.

Figure 15B:
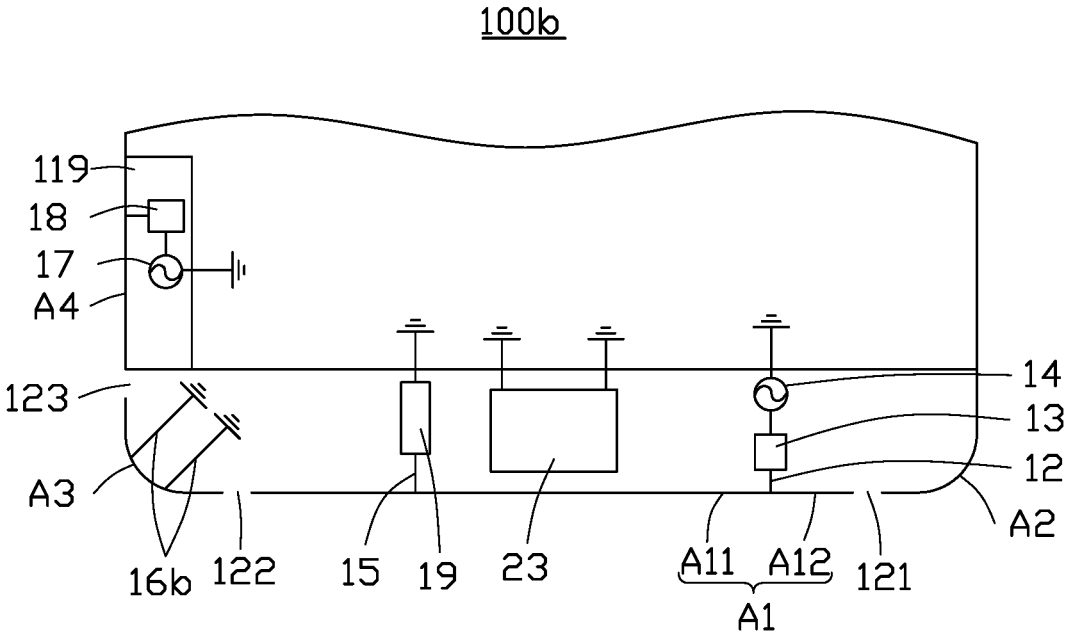

As illustrated in FIG. 15*b*, in one embodiment, the antenna structure 100*b* includes the first antenna, the second antenna, the isolation portion A3, and a plurality of ground portions 16*b* (for example, two ground portions 16*b*). The plurality of ground portions 16*b* is spaced apart from each other. One end of each ground portion 16*b* is electrically connected to the isolation portion A3. Another end of each ground portion 16*b* is grounded.

Figure 15C:
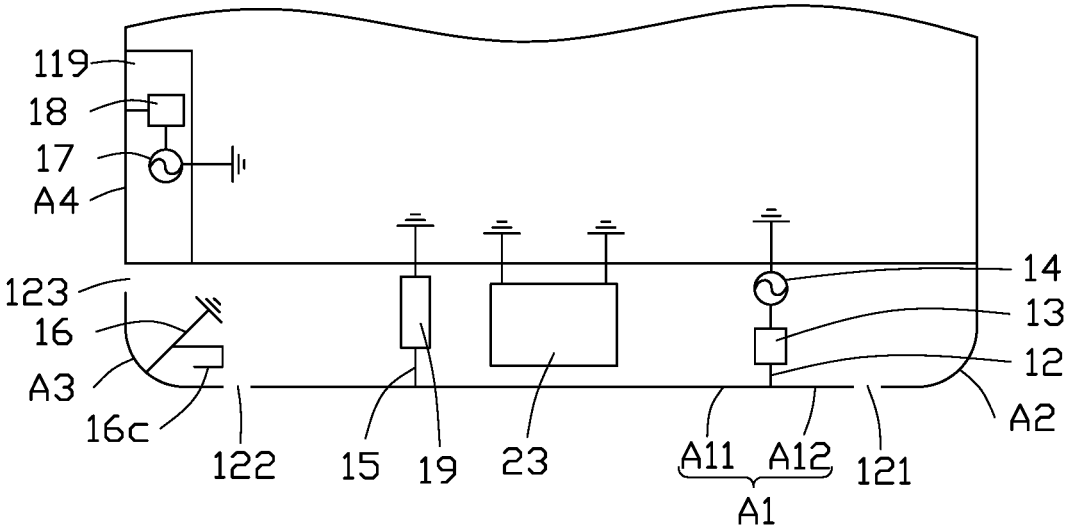

As illustrated in FIG. 15*c*, in one embodiment, the antenna structure 100*c* includes the first antenna, the second antenna, the isolation portion A3, the ground portion 16, and an extending portion 16*c*. The extending portion 16*c* can be any shape or structure. One end of the extending portion 16*c* is electrically connected to the ground portion 16. The extending portion 16*c* is configured to adjust a bandwidth of the first antenna or the second antenna.

Figure 15D:
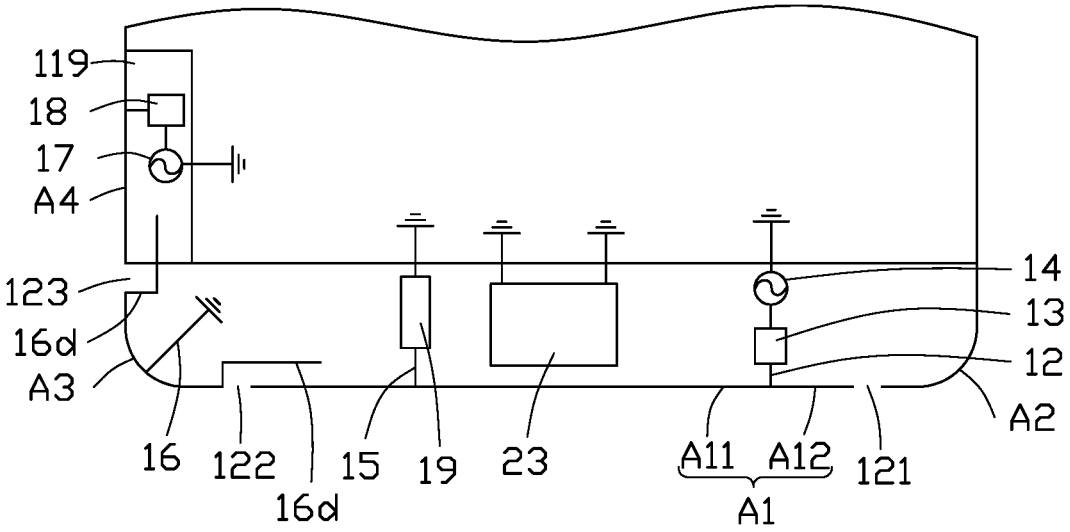

As illustrated in FIG. 15*d*, in one embodiment, the antenna structure 100*d* includes the first antenna, the second antenna, the isolation portion A3, the ground portion 16, and two extending portions 16*d*. The extending portion 16*d* can be any shape or structure. One end of one of the two extending portions 16*d* is electrically connected to an end of the isolation portion A3 adjacent to the second gap 122. Another end of one of the two extending portions 16*d* passes over the second gap 122 and extends to an inner side of the first radiating section A11. One end of the other one of the two extending portions 16*d* is electrically connected to an end of the isolation portion A3 adjacent to the groove 123. Another end of the other one of the two extending portions 16*d* passes over the groove 123 and extends to an inner side of the second radiating portion A4. That is, one end of each extending portion 16*d* is electrically connected to the isolation portion A3. Another end of each extending portion 16*d* is coupled to an adjacent first antenna or an adjacent second antenna for adjusting the bandwidth of the first antenna structure and the second antenna.

Figure 15E:
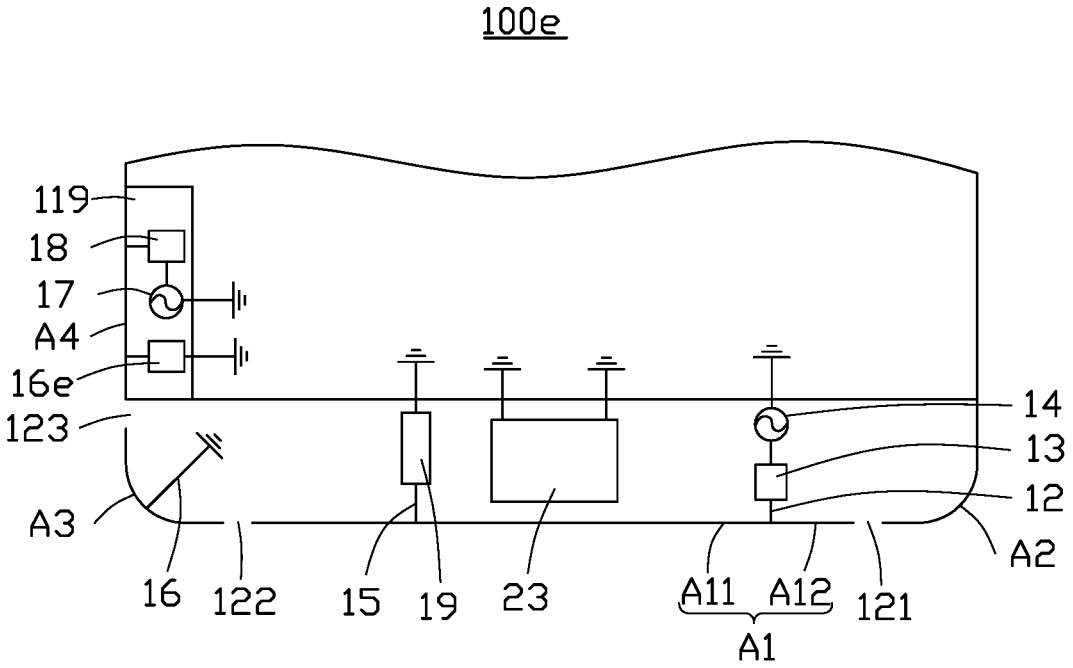

As illustrated in FIG. 15*e*, in one embodiment, the antenna structure 100*e* includes the first antenna, the second antenna, the isolation portion A3, the ground portion 16, and a loading circuit 16*e*. The loading circuit 16*e* can be a resistor, an inductor, a capacitor, a switching circuit, or other resistance element. One end of the loading circuit 16*e* is electrically connected to the second antenna, that is, the second radiating portion A4. Another end of the loading circuit 16*e* is grounded. The loading circuit 16*e* is configured to make the second antenna to cover the LTE-A low, middle, and high frequency bands, or other communication frequency bands.

Figure 15F:
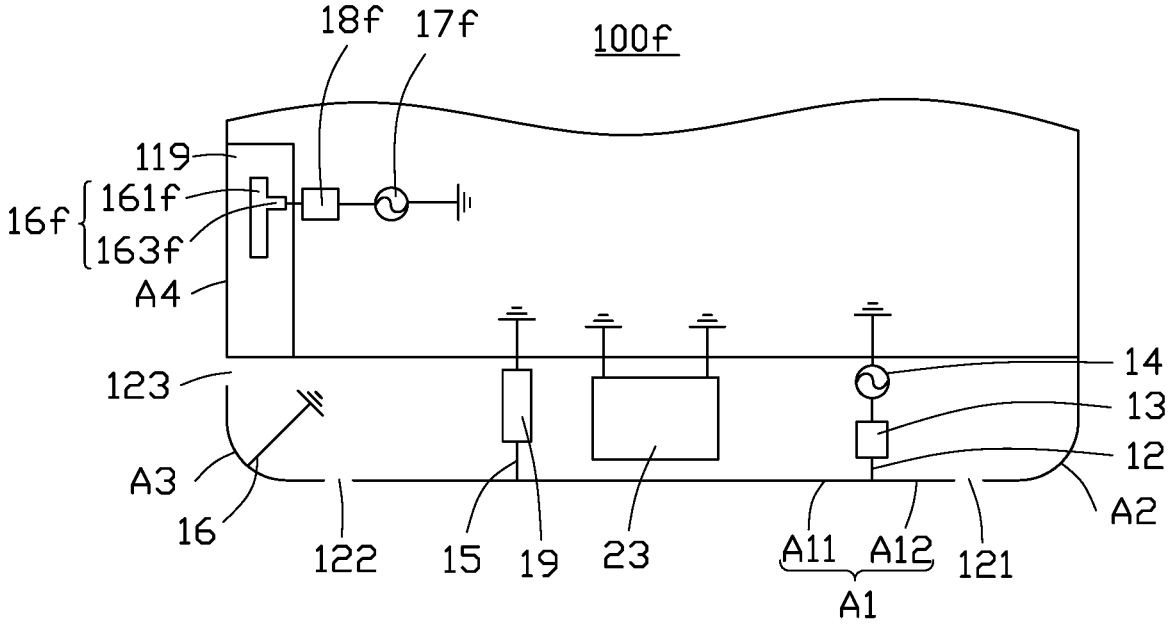

As illustrated in FIG. 15*f*, in one embodiment, the antenna structure 100*f* includes the first antenna, the second antenna, the isolation portion A3, the ground portion 16, a coupling unit 16*f*, a second feed source 17*f*, and a second matching circuit 18*f*.

The coupling unit 16*f* is made of metallic material and is positioned in the slit 119. The coupling unit 16*f* includes a coupling section 161*f* and a connecting section 163*f* The coupling section 161*f* is substantially rectangular. The coupling section 161*f* is positioned in the slit 119 and is substantially parallel to the second radiating portion A4. The connecting section 163*f* is substantially rectangular. The connecting section 163*f* is positioned in the slit 119. One end of the connecting section 163 is perpendicularly connected to one side of the coupling section 161*f*. Another end of the connecting section 163 extends along a direction parallel to the end portion 115 towards the first side portion 116.

The second feed source 17*f* and the second matching circuit 18*f* are both not positioned in the slit 119. One end of the second feed source 17*f*, through the second matching circuit 18*f*, is electrically connected to one end of the connecting section 163*f* away from the coupling section 161*f*. Another end of the second feed source 17*f* is grounded. Then, in this embodiment, the second feed source 17*f* supplies current to the second radiating portion A4, by means of coupling feeding. The second radiating portion A4 (i.e., the second antenna) forms a coupling-feed antenna.

Figure 15G:
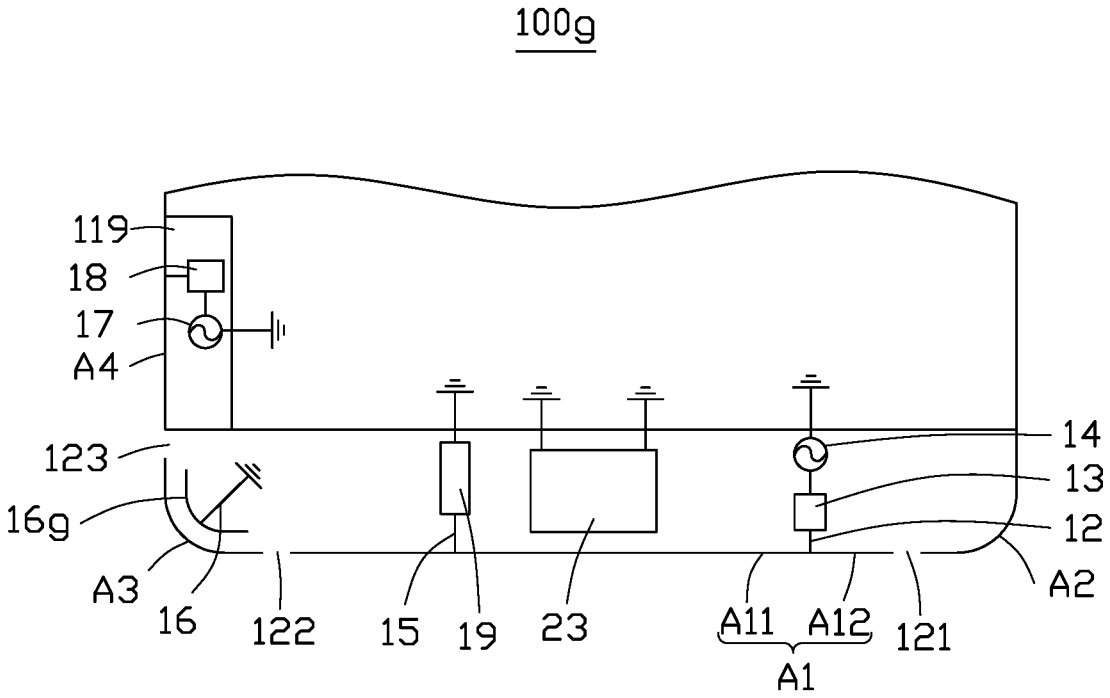

As illustrated in FIG. 15*g*, in one embodiment, the antenna structure 100*g* includes the first antenna, the second antenna, the isolation portion A3, the ground portion 16, and a coupling unit 16*g*. The coupling unit 16*g* is made of metallic material. A shape and a structure of the coupling unit 16*e* is similar to the isolation portion A3, The coupling unit 16*g* is spaced apart from and coupled to the isolation portion A3. One end of the ground portion 16 is electrically connected to the coupling unit 16*g*. Another end of the ground portion 16 is grounded. That is, in this embodiment, the isolation portion A3 is grounded through coupling to the coupling unit 16*g*. The current from the first antenna or the second antenna may be coupled to the isolation portion A3 after being coupled to the coupling unit 16*g*. Alternatively, current from the first antenna or the second antenna may be coupled to the coupling unit 16*g* after being coupled to the isolation portion A3.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing comprising a side frame, the side frame made of metallic material and defining a first gap, a second gap, and a groove; wherein the first gap, the second gap, and the groove cut across the side frame and divide the side frame into a first radiating portion, an isolation portion, and a second radiating portion;

a first feed source, the first feed source electrically connected to the first radiating portion for supplying current to the first radiating portion; and a second feed source, the second feed source electrically connected to or being coupled to the second radiating portion for supplying current to the second radiating portion;

wherein the isolation portion is positioned between and spaced apart from the first radiating portion and the second radiating portion, the isolation portion is grounded; and wherein the current from the first radiating portion and the current from the second radiating portion are respectively coupled to the isolation portion.

2. The antenna structure of claim 1, wherein the side frame comprises an end portion, a first side portion, and a second side portion, the first side portion and the second side portion are respectively connected to two ends of the end portion; wherein the first gap is defined in the end portion adjacent to the first side portion, the second gap is defined in the end portion adjacent to the second side portion, and the groove is defined in the second side portion adjacent to the second gap; a portion of the side frame between the first gap and the second gap forms the first radiating portion, a portion of the side frame between the second gap and the groove forms the isolation portion, a portion of the side frame extends from a side of the groove to the second side portion forms the second radiating portion, and a portion of the side frame extends from a side of the first gap to the first side portion forms a coupling portion; wherein when the first feed source supplies current, the current flows through the first radiating portion and is coupled to the coupling portion through the first gap for improving a bandwidth and an efficiency of the first radiating portion.

3. The antenna structure of claim 2, wherein a portion of the side frame between the first feed source and the second gap forms a first radiating section, a portion of the side frame between the first feed source and the first gap forms a second radiating section; wherein when the first feed source supplies current, the current flows through the first radiating section and is coupled to the isolation portion through the second gap to activate a first operating mode to generate radiation signals in a first radiation frequency band; when the first feed source supplies current, the current flows through the second radiating section and is coupled to the coupling portion through the first gap to activate a second operating mode to generate radiation signals in a second radiation frequency band.

4. The antenna structure of claim 3, further comprising a middle frame, wherein the middle frame is made of metallic material, the side frame is positioned around a periphery of the middle frame; wherein one side of the middle frame adjacent to the second side portion defines a slit, when the second feed source supplies current, the current flows through the second radiating portion and is coupled to the isolation portion through the slit to activate a third operating mode to generate radiation signals in a third radiation frequency band; and wherein the second radiating portion further uses the slit to activate a fourth operating mode to generate radiation signals in a fourth radiation frequency band.

5. The antenna structure of claim 4, wherein the first operating mode comprises LTE-A low and high frequency operating modes, the second operating mode is a LTE-A middle frequency operating mode, the third operating mode is a LTE-A middle frequency operating mode; and the fourth operating mode is a LTE-A high frequency operating mode; and wherein the isolation portion is configured to avoid the same frequency band of the first radiating portion and the second radiating portion for improving an isolation between the first radiating portion and the second radiating portion.

6. The antenna structure of claim 1, further comprising a plurality of ground portions, wherein the plurality of ground portions is spaced apart from each other, one end of each ground portion is electrically connected to the isolation portion, and another end of each ground portion is grounded.

7. The antenna structure of claim 1, further comprising a ground portion and a resistance unit, wherein one end of the ground portion is electrically connected to the isolation portion, another end of the ground portion is electrically connected to the resistance unit; wherein one end of the resistance unit is electrically connected to the ground portion, another end of the resistance unit is grounded.

8. The antenna structure of claim 1, further comprising a ground portion and an extending portion, wherein one end of the ground portion is electrically connected to the isolation portion, another end of the ground portion is grounded; and wherein one end of the extending portion is electrically connected to the ground portion for adjusting a bandwidth of the first radiating portion or the second radiating portion.

9. The antenna structure of claim 1, further comprising a ground portion and two extending portions, wherein one end of the ground portion is electrically connected to the isolation portion, another end of the ground portion is grounded; and wherein the two extending portions are extended by two ends of the isolation portion for adjusting a bandwidth of the first radiating portion or the second radiating portion.

10. The antenna structure of claim 1, further comprising a loading circuit, wherein one end of the loading circuit is electrically connected to the second radiating portion, another end of the loading circuit is grounded for making the second radiating portion to cover LTE-A low, middle, and high frequency bands.

11. The antenna structure of claim 1, further comprising a coupling unit, wherein the coupling unit comprises a coupling section and a connecting section, the coupling section is rectangular and is parallel to the second radiating portion; wherein the connecting section is rectangular, one end of the connecting section is perpendicularly connected to one side of the coupling section, one end of the second feed source is electrically connected to one end of the connecting section away from the coupling section, another end of the second feed source is grounded for coupling the current to the second radiating portion.

12. The antenna structure of claim 1, further comprising a coupling unit and a ground portion, wherein the coupling unit is spaced apart from the isolation portion, one end of the ground portion is electrically connected to the coupling unit, another end of the ground portion is grounded; and wherein the isolation portion is grounded through coupling to the coupling unit.

13. A wireless communication device comprising:

an antenna structure, the antenna structure comprising:

a housing, the housing comprising a side frame, the side frame made of metallic material and defining a first gap, a second gap, and a groove; wherein the first gap, the second gap, and the groove cut across the side frame and divide the side frame into a first radiating portion, an isolation portion, and a second radiating portion;

a first feed source, the first feed source electrically connected to the first radiating portion for supplying current to the first radiating portion; and a second feed source, the second feed source electrically connected to or being coupled to the second radiating portion for supplying current to the second radiating portion;

wherein the isolation portion is positioned between and spaced apart from the first radiating portion and the second radiating portion, the isolation portion is grounded; and wherein the current from the first radiating portion and the current from the second radiating portion are respectively coupled to the isolation portion.

14. The wireless communication device of claim 13, wherein the side frame comprises an end portion, a first side portion, and a second side portion, the first side portion and the second side portion are respectively connected to two ends of the end portion; wherein the first gap is defined in the end portion adjacent to the first side portion, the second gap is defined in the end portion adjacent to the second side portion, and the groove is defined in the second side portion adjacent to the second gap; a portion of the side frame between the first gap and the second gap forms the first radiating portion, a portion of the side frame between the second gap and the groove forms the isolation portion, a portion of the side frame extends from a side of the groove to the second side portion forms the second radiating portion, and a portion of the side frame extends from a side of the first gap to the first side portion forms a coupling portion; wherein when the first feed source supplies current, the current flows through the first radiating portion and is coupled to the coupling portion through the first gap for improving a bandwidth and an efficiency of the first radiating portion.

15. The wireless communication device of claim 14, wherein a portion of the side frame between the first feed source and the second gap forms a first radiating section, a portion of the side frame between the first feed source and the first gap forms a second radiating section; wherein when the first feed source supplies current, the current flows through the first radiating section and is coupled to the isolation portion through the second gap to activate a first operating mode to generate radiation signals in a first radiation frequency band; when the first feed source supplies current, the current flows through the second radiating section and is coupled to the coupling portion through the first gap to activate a second operating mode to generate radiation signals in a second radiation frequency band.

16. The wireless communication device of claim 15, wherein the antenna structure further comprises middle frame, the middle frame is made of metallic material, the side frame is positioned around a periphery of the middle frame; wherein one side of the middle frame adjacent to the second side portion defines a slit, when the second feed source supplies current, the current flows through the second radiating portion and is coupled to the isolation portion through the slit to activate a third operating mode to generate radiation signals in a third radiation frequency band; and wherein the second radiating portion further uses the slit to activate a fourth operating mode to generate radiation signals in a fourth radiation frequency band.

17. The wireless communication device of claim 13, wherein the antenna structure further comprises a plurality of ground portions, the plurality of ground portions is spaced apart from each other, one end of each ground portion is electrically connected to the isolation portion, and another end of each ground portion is grounded.

18. The wireless communication device of claim 13, wherein the antenna structure further comprises a ground portion and a resistance unit, one end of the ground portion is electrically connected to the isolation portion, another end of the ground portion is electrically connected to the resistance unit; wherein one end of the resistance unit is electrically connected to the ground portion, another end of the resistance unit is grounded.

19. The wireless communication device of claim 13, wherein the antenna structure further comprises a ground portion and an extending portion, one end of the ground portion is electrically connected to the isolation portion, another end of the ground portion is grounded; and wherein one end of the extending portion is electrically connected to the ground portion for adjusting a bandwidth of the first radiating portion or the second radiating portion.

20. The wireless communication device of claim 13, wherein the antenna structure further comprises a ground portion and two extending portion, one end of the ground portion is electrically connected to the isolation portion, another end of the ground portion is grounded; and wherein the two extending portions are extended by two ends of the isolation portion for adjusting a bandwidth of the first radiating portion or the second radiating portion.

21. The wireless communication device of claim 13, wherein the antenna structure further comprises a loading circuit, one end of the loading circuit is electrically connected to the second radiating portion, another end of the loading circuit is grounded for making the second radiating portion to cover LTE-A low, middle, and high frequency bands.

22. The wireless communication device of claim 13, wherein the antenna structure further comprises a coupling unit, the coupling unit comprises a coupling section and a connecting section, the coupling section is rectangular and is parallel to the second radiating portion; wherein the connecting section is rectangular, one end of the connecting section is perpendicularly connected to one side of the coupling section, one end of the second feed source is electrically connected to one end of the connecting section away from the coupling section, another end of the second feed source is grounded for coupling the current to the second radiating portion.

23. The wireless communication device of claim 13, wherein the antenna structure further comprises a coupling unit and a ground portion, the coupling unit is spaced apart from the isolation portion, one end of the ground portion is electrically connected to the coupling unit, another end of the ground portion is grounded; and wherein the isolation portion is grounded through coupling to the coupling unit.

* * * * *